US012338839B1

(12) United States Patent
Lin et al.

(10) Patent No.: US 12,338,839 B1
(45) Date of Patent: Jun. 24, 2025

(54) INTEGRATED FAN GUARD

(71) Applicant: ZT Group Int'l, Inc., Secaucus, NJ (US)

(72) Inventors: Ting Yu Lin, Secaucus, NJ (US); Felix Fang Ning Liu, Secaucus, NJ (US)

(73) Assignee: ZT Group Int'l, Inc., Secaucus, NJ (US)

( * ) Notice: Subject to any disclaimer, the term of this patent is extended or adjusted under 35 U.S.C. 154(b) by 0 days.

(21) Appl. No.: 18/301,435

(22) Filed: Apr. 17, 2023

(51) Int. Cl.
*F04D 29/70* (2006.01)
*F04D 19/00* (2006.01)
*F04D 29/64* (2006.01)

(52) U.S. Cl.
CPC ..... *F04D 29/703* (2013.01); *F04D 19/002* (2013.01); *F04D 29/644* (2013.01)

(58) Field of Classification Search
None
See application file for complete search history.

(56) References Cited

U.S. PATENT DOCUMENTS 7,369,408 B2 * 5/2008 Chang ..... F04D 25/0613 361/710
9,506,375 B2 * 11/2016 Cachia ..... F01D 25/243
2007/0086162 A1 * 4/2007 Chang ..... F04D 25/0613 361/695
2009/0021911 A1 * 1/2009 Lee ..... F04D 25/166 361/695
2012/0113591 A1 * 5/2012 Chuang ..... H05K 7/20172 361/695
2013/0309067 A1 * 11/2013 Cachia ..... F01D 25/243 415/121.2

* cited by examiner

*Primary Examiner* — Juan G Flores
(74) *Attorney, Agent, or Firm* — Dergosits & Noah LLP; Todd A. Noah

(57) ABSTRACT

An apparatus is provided that integrates the fan grill and mounting pins, which facilitates the installation and removal of fans from tight locations, e.g., servers. Thus, avoiding the potential that separate mounting pins are accidentally lost, which may result in an unstable fan mounting, or left behind in the server, which may result in an out-of-line fan mounting. In addition, embodiments may include curved upper mounting pins, which provides features that may be grasped by a technician during installation and removal.

20 Claims, 4 Drawing Sheets

INTEGRATED FAN GUARD

FIELD OF THE INVENTION

The present subject matter relates generally to fans and, more specifically, to mounts for fans.

BACKGROUND

Fans are typically a major source of server service issues. FIG. 1 is an upper front right isometric view of a prior art fan 10. In FIG. 1, fan 10 includes a body 12, to which a fan guard 30 is attached at each end, and fan mounts 20*a* . . . 20*d* are attached at the base. In the following, discussion directed to an element number, e.g., 20, applies equally to elements designated by that number and a letter, e.g., 20*a*, 20*b*.

Body 12 includes lobes 14*a* . . . 14*d* and 16*a* . . . 16*d*, which have parallel holes configured to receive fan mounts 20*a* . . . 20*d* and guard rivets 40*a* . . . 40*d*, respectively. In some instances, fan body 12 may further include lobes 18*a*, 18*b*. The lobes in each of lobe families 14, 16, and 18 are relatively small compared to a technician's fingertips, as are gaps 19*a*, 19*b*, which combine to make these features difficult to grasp and, therefore, ill-suited for use during installation and removal. Mounts 20*a* . . . 20*d*, each include a mount head 22, a post 24, and a base 26, the relative differences in head 22, post 24, and base 26 defining a notch. A mounting pin 28 extends from base 26 through the corresponding lobe, e.g., lobe 14*b*. Typically, pins 28 are retained within lobes 14 by a compression fit. Each fan guard 30 includes a grill 34, which protects the technician from fan blades and through which the airflow passes, and lobes 32*a*, 32*b*. Fan guard 30 is attached to body 12 by rivets or fasteners 40*a*, 40*b* passing through corresponding lobes 32*a*, 32*b* of fan guard 30 and into lobes 16*a*, 16*b* of body 12. Fasteners 40 are retained within lobes 16 also typically by a compression fit.

FIG. 2 is an upper right isometric view of a prior art installation of fan 10. In FIG. 2, fan 10 is installed in a server chassis 60 with each fan mount 20 receiving a chassis rail 50 in the notch of mount 20, and with mount 20 being received by elements of a chassis mounting rail 50. Mounting rail 50 includes mounting notches 52. A rail section 54 defines the side of a notch 52 that is nearest another fan 10. A rail section 56 defines the side of a notch 52 that toward the interior of the fan. A trough 58 in rail 50 reduces the height of rail 50 where it may impede airflow through a fan 10.

FIG. 2 illustrates two potential issues. First, a fan mount 20 may remain or be installed in notch 24 without an accompanying fan. Thus, should a technician not notice the odd mount, a subsequent attempt to install a fan 10 could result in the fan being misaligned or not otherwise properly secured. Second, a fan mount 20 may be accidentally removed from a fan 10. Should a subsequent attempt be made to install the fan with a missing mount 20, that fan may be unstable. In both cases, time is wasted.

An incorrect initial installation may also impact later performance in many ways, e.g.: the fan may vibrate excessively inside the chassis; the fan may contact a chassis cover an transmit vibration to the chassis; or the fan may become stuck in the chassis.

Even when a fan is installed as specified, other issues with fan installation include the fans being installed so closely together that installation and removal is difficult and tools may be needed.

Thus, what is needed is an apparatus that reduces the potential for fans to be mis-mounted.

BRIEF DESCRIPTION OF THE DRAWINGS

The embodiments are illustrated by way of example and not limitation in the accompanying drawings, in which like references indicate similar elements, and in which.

DETAILED DESCRIPTION

Embodiments described within disclose a fan guard that integrates rivets, fan guard, and fan mounts, resulting in an apparatus that reduces the potential for mis-mounting the fan. In an embodiment, the integrated fan guard also includes extended curved sections on the rivets that a technician may easily grasp, which facilitates the installation and removal of the fan.

Figure 3:
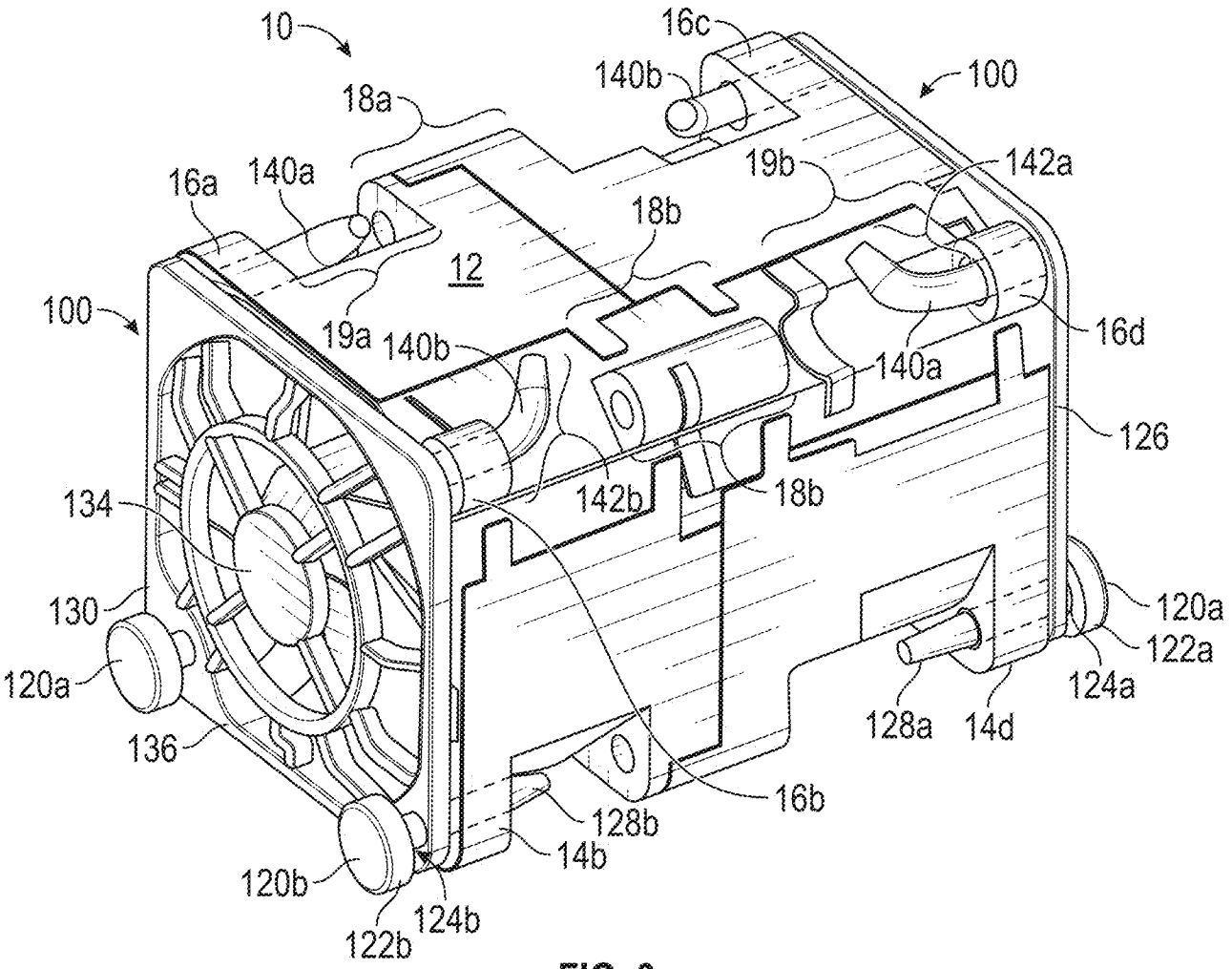
FIG. 3 is an upper front right isometric view illustrating an embodiment of a fan including an integrated fan guard.

FIG. 3 is an upper front right isometric view illustrating an embodiment of a fan including an integrated fan guard 100. In FIG. 3, each integrated fan guard 100 includes mounts 120*a*, 120*b*, rivets 140*a*, 140*b*, and a fan guard 134. Fan guard 134 includes a grill 130 and a perimeter face 136 that includes corner sections to which mounts 120*a*, 120*b* and rivets 140*a*, 140*b* are connected.

Figure 1:
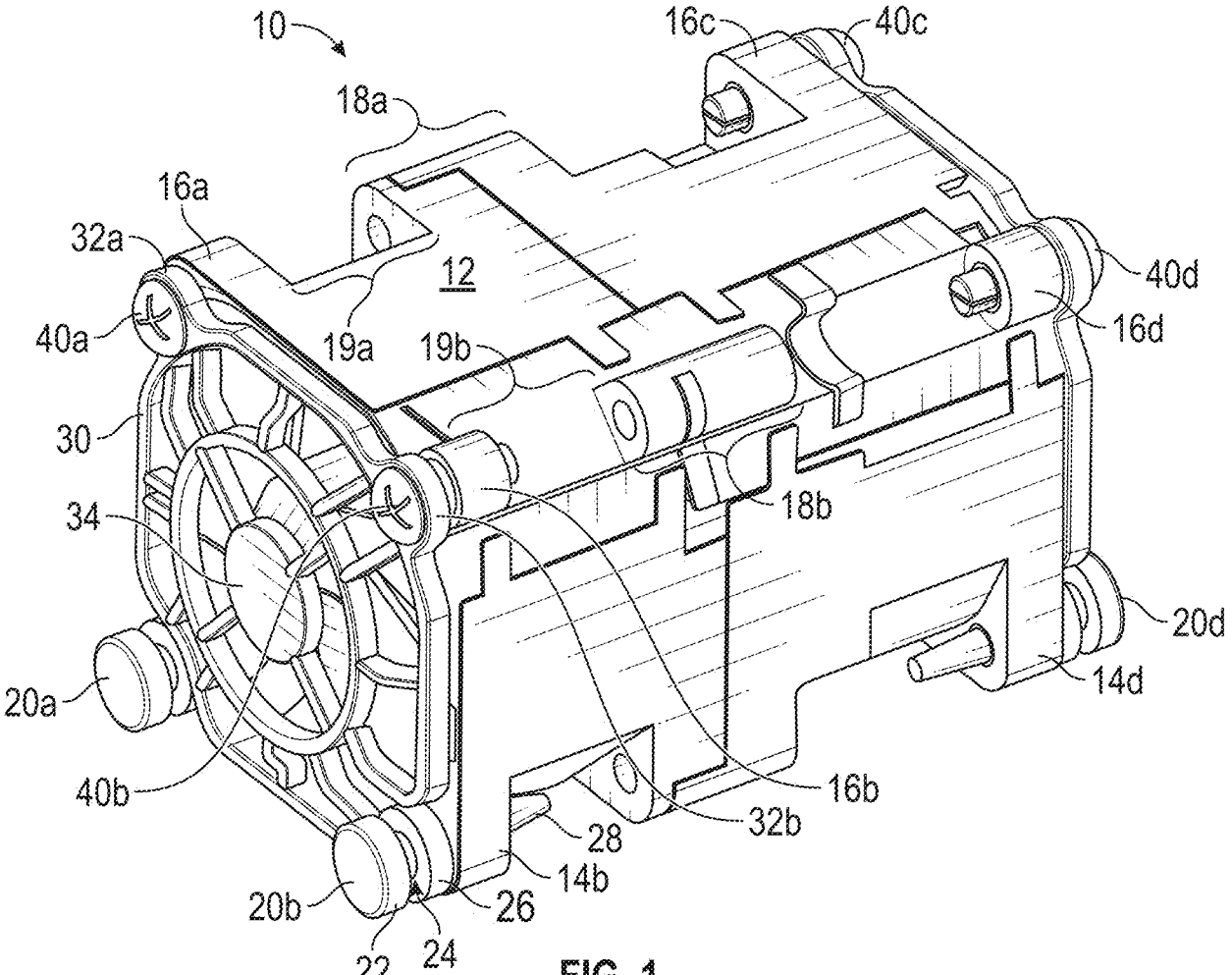
FIG. 1 (Prior Art)
FIG. 1 is an upper front right isometric view of a prior art fan.
Figure 2:
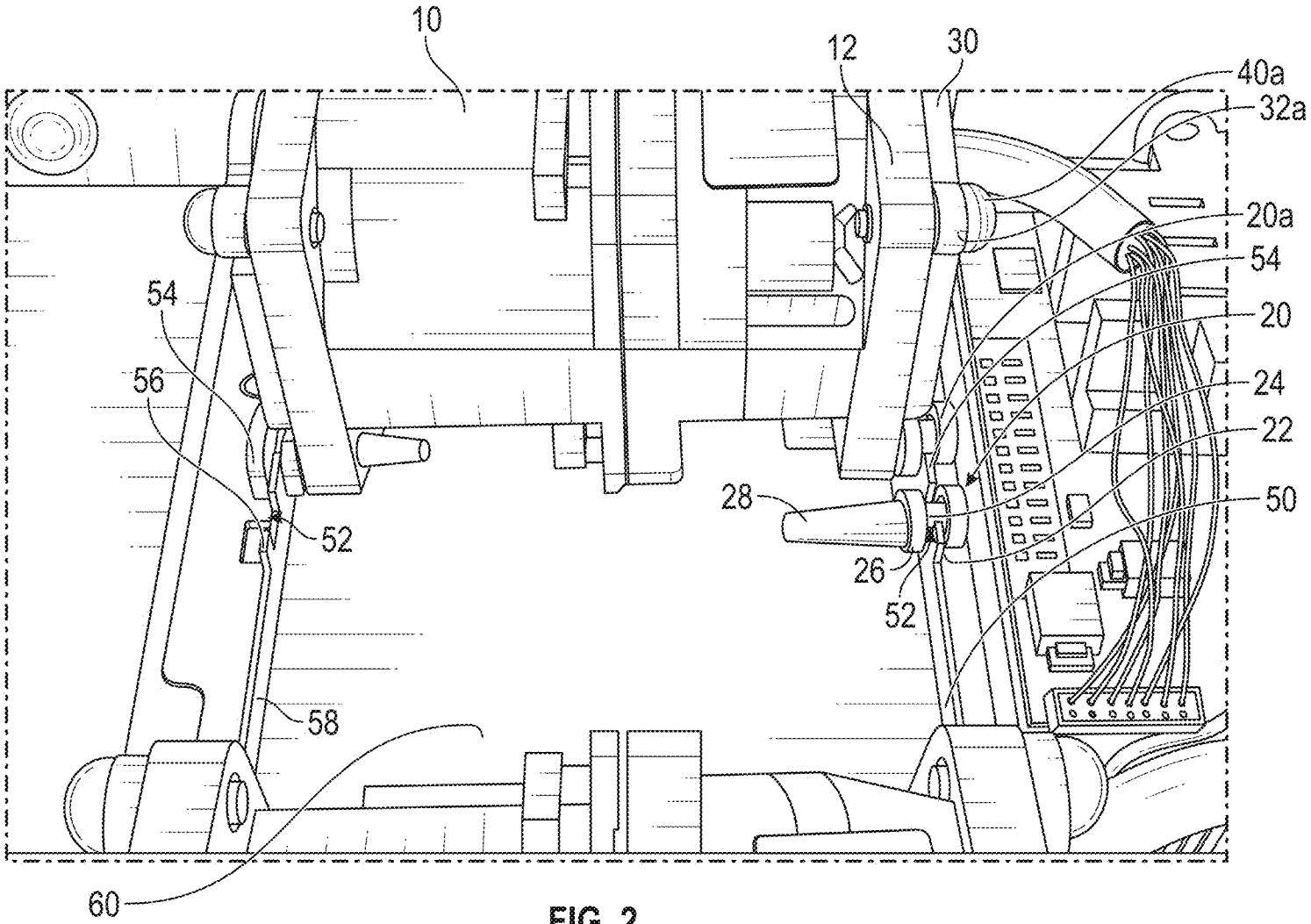
FIG. 2 (Prior Art)
FIG. 2 is an upper right isometric view of a prior art fan installation.

Mounts 120*a*, 120*b*, extend from lower corners of perimeter face 136, each mount including a head 122 and a post 124, which, with perimeter face 136, define a notch configured to receive mounting rail 50 and fit within notch 52 as discussed with reference to FIG. 1 and FIG. 2. A mounting pin 128 extends from the interior face of perimeter face 136 through the corresponding lobe, e.g., lobe 14*b* for mounting pin 128*b*. Pins 128 may be retained within lobes 14 by a compression fit. Thus, fan guard 100 may be connected to the lower section of body 12 by pins 128*a*, 128*b*.

Rivets 140*a*, 140*b* extend from the interior face of perimeter face 136 through the corresponding lobe, e.g., lobe 16*a* for rivet 140*a*. Each rivet 140 includes a curved section 142, which extends, in the orientation shown, upwardly and inwardly toward a centerline of body 12. In an embodiment, to accommodate curved section 142 when installing integrated fan guard 100, the diameter of curved section 142 is reduced in comparison to the diameter of the hole through the corresponding lobe 16. Thus, rivets 140 may be retained within lobes 15 by a mechanical interference with curves 142 cooperating with compression-fit pins 128 to hinder the removal of integrated fan guard 100 from body 12. In an embodiment, to accommodate curved section 142 when installing integrated fan guard 100, curved section 142 may be constructed of a resilient material that deforms during installation and returns to the curved shape of FIG. 3 after passing through lobe 16. Thus, rivets 140 may be retained within lobes 16 by a compression fit with the compression fit of rivets 140 cooperating with compression-fit pins 128 to hinder the removal of integrated fan guard 100 from body 12.

As shown in FIG. 3, the tips of curved section 142 do not align with the holes in lobes 16. Thus, to install integrated fan guard 100, curved sections 142 must be forcibly separated until the tips align with the holes in lobes 16. For example, curve section 142 may be slightly bent until the tips aligns with the holes in lobe 16. Then, rivets 140 are pushed into the holes of lobes 16. As curved sections 142 pass into lobes 16, the interior face of perimeter face 136 is brought closer to fan body 12. In concert with face 136 nearing body 12, the tips of mounting pins 128 are guided into holes in lobes 14, after which face 136 may be snugged up against fan body 12.

In an embodiment, mounts 120 may be configured to cooperate with rails of different shapes. For example, if rail 50 were linear and of regular height, i.e., without features such as bumps 56, the function of dispersed mounts 120*a*, 120*b* may be accomplished by a single mount with a wider notch, e.g., a single mount with a notch that ran for the entire length of the base of fan mount 100, or some fraction thereof.

In an embodiment, rivets 140 may be configured such that the curvature is entirely upward, given the orientation shown in FIG. 3, without the inward component of curvature that results in rivets 140 curving inwardly toward a centerline of body 12.

Figure 4:
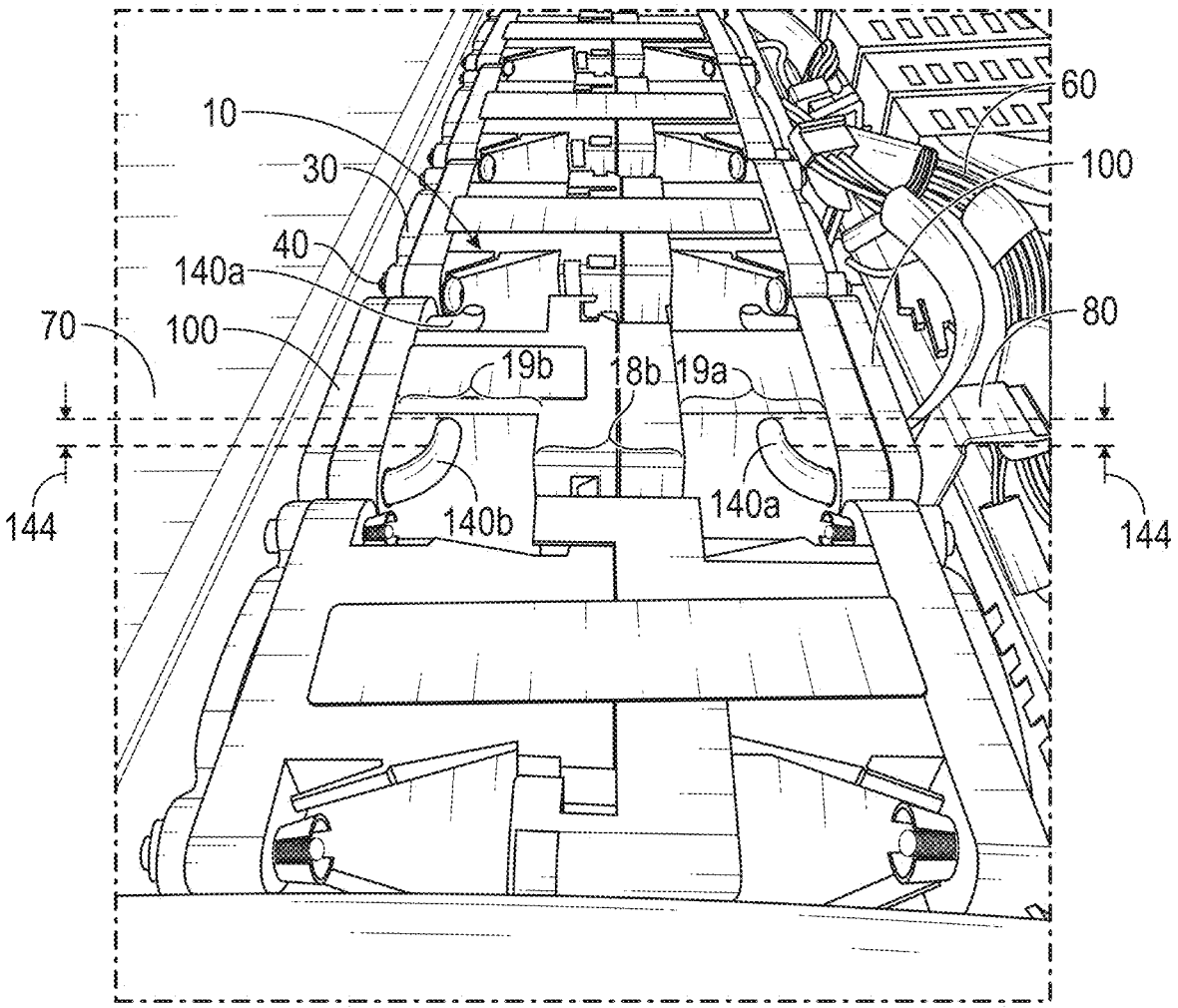
FIG. 4 is an upper right isometric view illustrating the installation of an embodiment of a fan including an integrated fan guard.

FIG. 4 is an upper right isometric view illustrating the installation of a fan including integrated fan guards 100 on each end of fan body 12. In FIG. 4, fan 10 is installed between other fans in a row that is disposed between a chassis element 70 and chassis elements 80, which severely limits access to fan 10. Embodiments of fan guard 100 facilitate the installation and removal of fan 10 from such situations by providing curved sections 142, which curve upwardly a distance 144 above fan body 12. In the embodiment, curved sections 142 also curve inwardly a similar distance toward a centerline, or center vertical plane, of fan 10. Thus, the tips of curved sections 142 are at a distance from other parts of fan 10 that allows them to be grasped by a technician for removal and installation. In embodiments, distance 144 is designed to allow an average finger to grasp curved section 142, which in this embodiment is approximately 1 cm. A feature of curved section 142 curving both upwardly and inwardly is that the tip of each curved section 142 is distanced inwardly and, therefore, away from a tip of a curved section 142 of an adjacent fan guard 100. In other words, the tips of curved sections 142 of adjacent rivets 140 are separated by the curvature. This is unlike the tips of adjacent rivets 40, which are extremely close together.

For example, to remove fan 10, a technician may grasp pin 140*a* on the left side of FIG. 4 with the thumb and index finger of one hand, and grasp the diagonally opposed pin 140*a* on the other end of body 12 with the thumb and index finger of the other hand, and lift fan 10 off rails 50 and out of server 60. In contrast, it has been found that fan body lobes 18*a*, 18*b* are too small for practical use by technicians during removal and installation.

Generally, in embodiments, integrated fan guard 100 includes: rivets 140 that fix the upper fan guard to the fan body and provide features that may be grasped during removal and installation; a fan grill 130 that protects the technician; and fan mounts 120 that receive grill 50 and attach fan 10 to chassis 60. These features combine to improve the installation and removal process, which may result in a reduction in installation issues, e.g., a reduction in fan vibration due to misalignment.

For example, in an embodiment, a fan guard comprises: a grill; a first mount provided on a first face of the grill and including a first notch oriented in a first direction; and a plurality of pins provided on a second face of the grill, pins in a first subset of the plurality of pins including a curved section, wherein: the plurality of pins are configured to be received within a corresponding plurality of parallel holes; and a first component of a curvature of the curved section is directed away from the from the first direction.

In addition, in an embodiment, an apparatus comprises: a body; a first grill mounted to a first end of the body; a second grill mounted to a second end of the body; each grill including: a first mount provided on a first face of the grill and including a first notch oriented in a first direction; and a plurality of pins provided on a second face of the grill, pins in a first subset of the plurality of pins including a curved section, wherein: the plurality of pins are received within a corresponding plurality of parallel holes in the body; and a first component of a curvature of the curved section is directed away from the from the first direction.

And, in an embodiment, a method for removing a body from a chassis comprises: a step of providing the body with: a first grill mounted to a first end of the body; a second grill mounted to a second end of the body; each grill including: a first mount provided on a first face of the grill and including a first notch oriented in a first direction; and a plurality of pins provided on a second face of the grill, pins in a first subset of the plurality of pins including a curved section, wherein: the plurality of pins are received within a corresponding plurality of parallel holes in the body; and a first component of a curvature of the curved section is directed away from the from the first direction; a step of grasping, by a user, the curved section of a first pin on the first grill; a step of grasping, by the user, the curved second of a second pin on the second grill; and a step of removing, by the user, the body from the chassis by pulling the first pin and the second pin.

The previous description is provided to enable any person skilled in the art to practice the various aspects described herein. In the embodiments, the separation of various system components in the embodiments described above should not be understood as requiring such separation in all embodiments. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. An apparatus comprising:

a grill configured to be attached to a fan body;

a first mount provided on a first face of the grill and including a first notch oriented in a first direction; and a plurality of pins provided on a second face of the grill, the plurality of pins including a first subset of pins, each pin in the first subset having a substantially straight section, the substantially straight section comprising a first plurality of cross-sections, each of the first plurality of cross-sections having a center such that the first plurality of cross-section centers define a first centerline of symmetry and a curved section comprising a second plurality of cross-sections, each of the second plurality of cross-sections having a center such that the second plurality of cross-section centers define a second centerline of symmetry having a curvature, wherein a first component of the curvature bends away from the first centerline in a direction away from the first direction, and wherein the plurality of pins are configured to be received within a corresponding plurality of parallel holes in the fan body.

2. The apparatus of claim 1, wherein the first mount includes a first post extending from the first face and a first head atop the first post; and the first notch is defined by the first face, first post, and first head.

3. The apparatus of claim 2, wherein pins in a second subset of the plurality of pins are straight and extend perpendicularly from the second face of the grill.

4. The apparatus of claim 3, further including a second mount provided on the first face of the grill and including a second notch oriented in the first direction, wherein:

a first pin of the second subset extends from the second face in line with the first post; and a second pin of the second subset extends from the second face in line with a second post of the second mount.

5. The apparatus of claim 4, wherein the curvature of the curved section includes a second component of curvature directed toward a centerline of the grill.

6. The apparatus of claim 5, wherein the pins in the first subset of the plurality of pins include a straight section between the curved section and the second face of the grill, a length of the straight section corresponding to a depth of the corresponding parallel hole.

7. The apparatus of claim 5, wherein:

a first pin of the first subset of pins is disposed in a first corner section of the grill;

a second pin of the first subset of pins is disposed in a second corner section of the grill;

the first component of curvature directed away from the first direction includes both the first pin and the second pin curving away from the first direction; and the second component of curvature directed toward the centerline of the grill includes both the first pin and the second pin curving inward toward the centerline of the grill.

8. The apparatus of claim 1, wherein the curvature of the curved section includes a second component of curvature directed toward a centerline of the grill.

9. The apparatus of claim 8, wherein the pins in the first subset of the plurality of pins include a straight section between the curved section and the second face of the grill, a length of the straight section corresponding to a depth of the corresponding parallel hole.

10. The apparatus of claim 8, wherein:

a first pin of the first subset of pins is disposed in a first corner section of the grill;

a second pin of the first subset of pins is disposed in a second corner section of the grill;

the first component of curvature directed away from the first direction includes both the first pin and the second pin curving away from the first direction; and the second component of curvature directed toward the centerline of the grill includes both the first pin and the second pin curving inward toward the centerline of the grill.

11. The apparatus of claim 10, wherein the first mount includes a first post extending from the first face and a first head atop the first post; and the first notch is defined by the first face, first post, and first head.

12. The apparatus of claim 11, wherein pins in a second subset of the plurality of pins are straight and extend perpendicularly from the second face of the grill.

13. The apparatus of claim 12, further including a second mount provided on the first face of the grill and including a second notch oriented in the first direction, wherein:

a first pin of the second subset extends from the second face in line with the first post; and a second pin of the second subset extends from the second face in line with a second post of the second mount.

14. An apparatus comprising:

a body;

a first grill mounted to a first end of the body;

a second grill mounted to a second end of the body;

each grill including:

a first mount provided on a first face of the grill and including a first notch oriented in a first direction, and a plurality of pins provided on a second face of the grill, pins in a first subset of the plurality of pins including a curved section, wherein the plurality of pins are received within a corresponding plurality of parallel holes in the body and a first component of a curvature of the curved section is directed away from the from the first direction.

15. The apparatus of claim 14, wherein, for each grill, the curvature of the curved section includes the first component of curvature directed away from the first direction and a second component of curvature directed toward a centerline of the body.

16. The apparatus of claim 15, wherein, for each grill, the pins in the first subset of the plurality of pins include a straight section between the curved section and the second face of the grill, a length of the straight section corresponding to a depth of the corresponding parallel hole.

17. The apparatus of claim 15, wherein, for each grill:

a first pin of the first subset of pins is disposed in a first corner section of the grill;

a second pin of the first subset of pins is disposed in a second corner section of the grill;

the first component of curvature directed away from the first direction includes both the first pin and the second pin curving away from the first direction; and the second component of curvature directed toward the centerline of the body includes both the first pin and the second pin curving inward toward the centerline of the body.

18. The apparatus of claim 17, wherein, for each grill, pins in a second subset of the plurality of pins are straight and extend perpendicularly from the second face of the grill.

19. The apparatus of claim 18, the apparatus further including for each grill, a second mount provided on the first face of the grill and including a second notch oriented in the first direction, wherein, for each grill:

the first mount includes a first post extending from the first face and a first head atop the first post; and the first notch is defined by the first face, first post, and first head;

a first pin of the second subset extends from the second face in line with the first post; and a second pin of the second subset extends from the second face in line with a second post of the second mount.

20. A method for removing a fan body from rails of a chassis comprising:

grasping a curved section of a first pin attached to a first grill mounted to a first end of the fan body, the first grill having a first mount provided on a first face of the grill and including a notch oriented in a first direction to engage with the rails of the chassis, the first pin being provided on a second face of the first grill and the first pin having a substantially straight section comprising a first plurality of cross-sections, each of the first plurality of cross-sections having a center such that the first plurality of cross-section centers define a first centerline of symmetry and a curved section comprising a second plurality of cross-sections, each of the second plurality of cross-sections having a center such that the second plurality of cross-section centers define a second centerline of symmetry having a curvature, wherein a first component of the curvature is configured to bend away from the first centerline in a direction away from the first direction;

grasping a curved section of a second pin attached to a second grill mounted to a second end of the fan body, the second grill having a first mount provided on a first face of the second grill and including a notch oriented in the first direction to engage with the rails of the chassis, the second pin being provided on a second face of the second grill and the second pin having a substantially straight section comprising a first plurality of cross-sections, each of the first plurality of cross-sections having a center such that the first plurality of cross-section centers define a first centerline and a curved section comprising a second plurality of cross-sections, each of the second plurality of cross-sections having a center such that the second plurality of cross-section centers define a second centerline having a curvature, wherein a first component of the curvature is configured to bend away from the centerline in a direction away from the first direction; and removing the fan body from the rails of the chassis by pulling the first pin curved section and the second pin curved section of the second pin and lifting the fan body off the rails of the chassis.

* * * * *